United States Patent [19]

Friedland

[11] Patent Number: 4,720,194

[45] Date of Patent: Jan. 19, 1988

[54] LIQUID MIXING APPARATUS

[76] Inventor: Donald R. Friedland, 8300 Dupont Ave. No., Minneapolis, Minn. 55444

[21] Appl. No.: 4,026

[22] Filed: Jan. 16, 1987

[51] Int. Cl.[4] ..... B01F 9/12

[52] U.S. Cl. ..... 366/221; 366/222; 366/224; 366/235

[58] Field of Search ..... 366/605, 214, 220, 224, 366/235, 197, 221, 222, 223; 74/665 GE; 192/67 P

[56] References Cited

U.S. PATENT DOCUMENTS

| | | | |
|---|---|---|---|
| 295,783 | 3/1884 | Matter . | |
| 2,651,582 | 9/1953 | Courtney | 106/167 |
| 2,910,277 | 10/1959 | Brown | 366/197 |
| 3,809,322 | 5/1974 | Hirosawa | 241/41.17 |
| 4,023,777 | 5/1977 | Kimmel . | |
| 4,166,705 | 9/1979 | Fronske | 366/221 |
| 4,403,867 | 9/1983 | Duke | 366/142 |

FOREIGN PATENT DOCUMENTS

| | | | |
|---|---|---|---|
| 269154 | 5/1971 | U.S.S.R. | 366/220 |

*Primary Examiner*—Timothy F. Simone
*Assistant Examiner*—Kevin L. Butler
*Attorney, Agent, or Firm*—Leo Gregory

[57] ABSTRACT

Apparatus mixing printing inks consisting of two or more mixing containers having a single power source for rotating both the containers and the mixing blades therein and being arranged to rotate the containers and their respective mixing blades individually or collectively.

8 Claims, 6 Drawing Figures

LIQUID MIXING APPARATUS

BACKGROUND OF THE INVENTION

1. Field of the Invention.

This invention relates to a printing ink mixing apparatus.

2. Description of the Prior Art.

This invention relates to a printing ink mixing apparatus being particularly adapted to have two or more mixing containers and their respective mixing blades driven from a common power source.

The prior art discloses the use of mixing apparatus arranged to have only one mixing container such as in U.S. Pat. No. 4,403,867 to Duke and here separate power sources are used to drive the container and the mixing blades therein.

In U.S. Pat. No. 295,783 to Matter, there is shown a pair of sifting containers and brushes all driven from a common power source but the apparatus does not appear to permit the coupling of additional sifting containers.

SUMMARY OF THE INVENTION

It is a particular object of this invention to provide an apparatus readily adapted for the cooperative arrangement of two or more mixing containers all operated from a common power source.

It is a further object of this invention to operate the mixing containers of this invention collectively or individually.

It is another object of this invention to provide a mixing apparatus which embodies driving connections from a power source which can be readily expanded to drive additional mixing containers and mixing blades.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
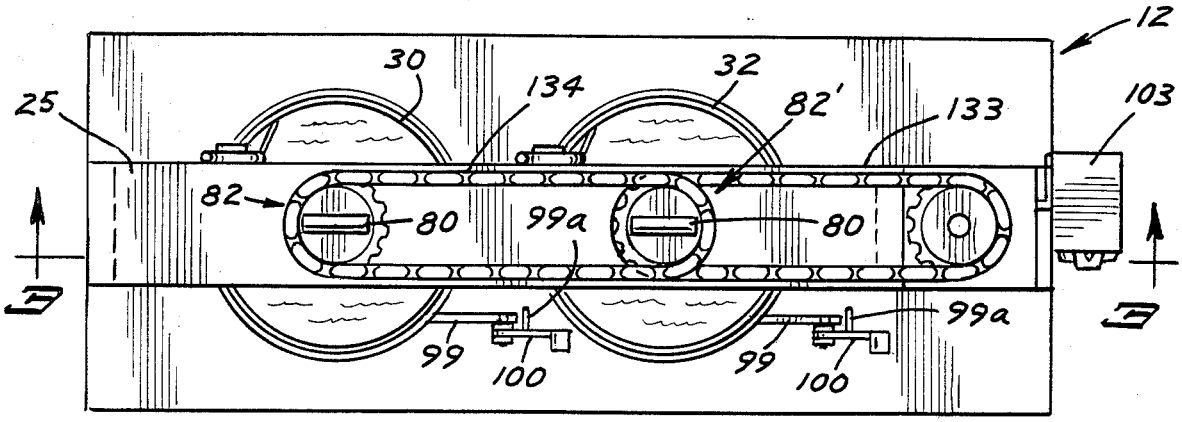
FIG. 1 is a top plan view.
Figure 2:
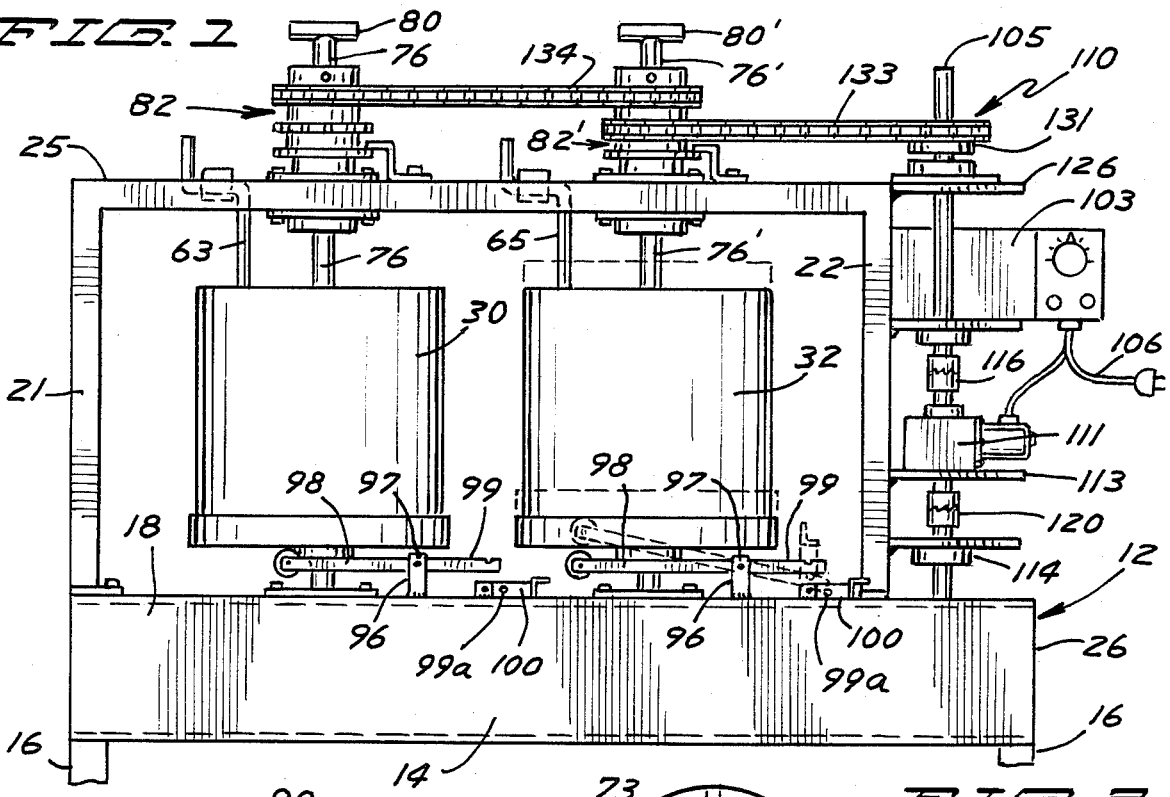
FIG. 2 is a view in front elevation.

Referring to the drawings and particularly to FIGS. 1 and 2, the apparatus herein is indicated generally by the reference numeral 10.

Supporting the apparatus in the embodiment shown is a table member 12 having a bottom plate or wall 14 supported on legs 16, a top wall 18 forming a chamber 19 therebetween and having upstanding frame members 21 and 22 supporting an upper cross member 25. Said table member 12 has side walls about said chamber of which the wall 26 is shown.

In the present embodiment, two mixing containers 30 and 32 are shown for purpose of illustration. The gear train to be described driving or rotating said containers and the mixing blades therein permit an extension thereof to operate additional mixing containers and their respective mixing blades.

Figure 3:
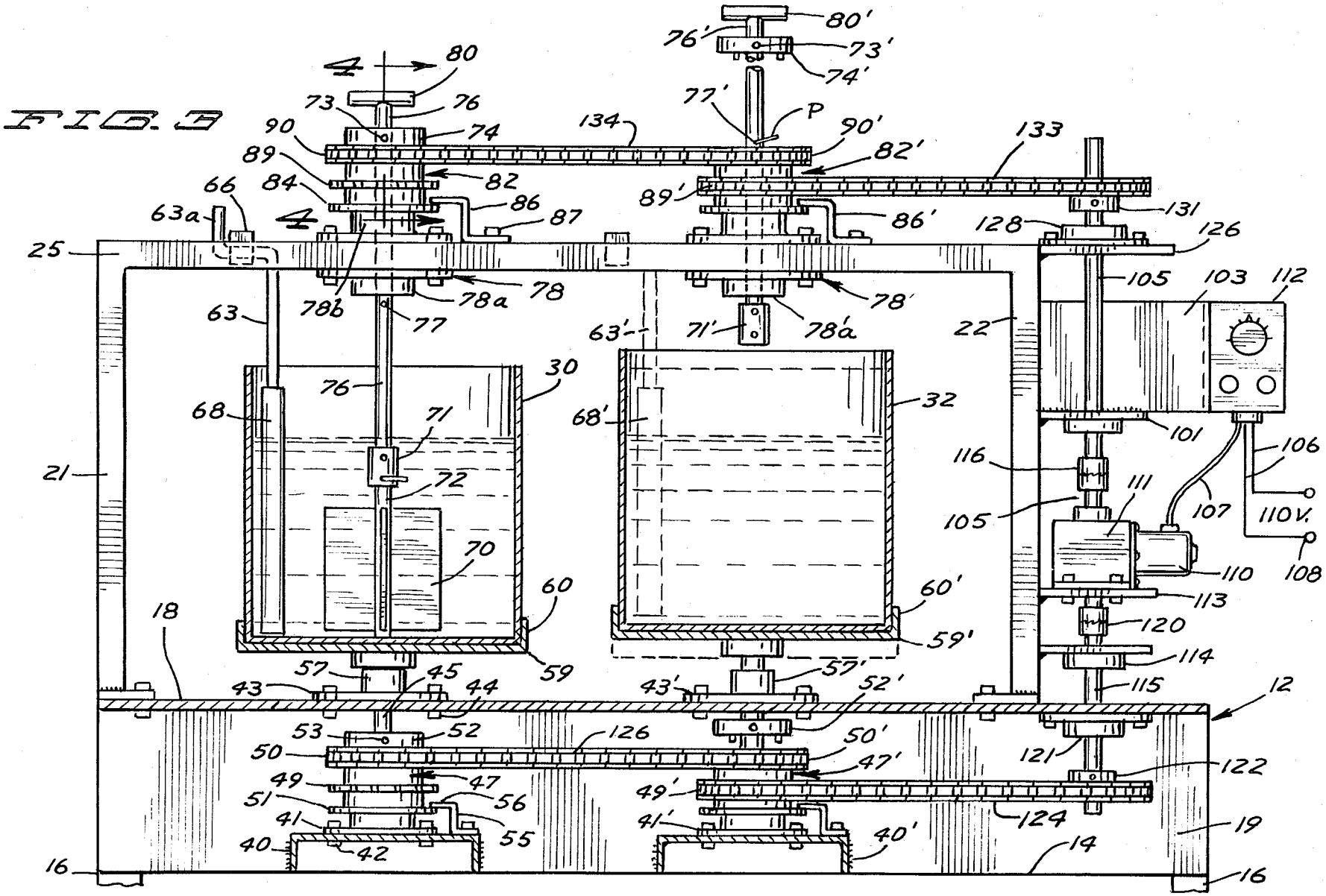
FIG. 3 is an expanded view in vertical section taken on line 3—3 of FIG. 1 as indicated.

Referring to FIG. 3, the mixing container 30 and related structure will be described and will be representative of the mixing container 32 of which like parts will be described by like reference characters with a prime added.

Figure 4:
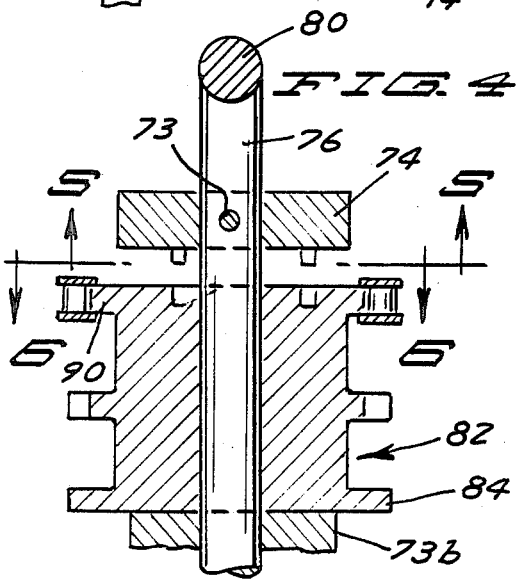
FIG. 4 is a broken view in vertical section taken on line 4—4 of FIG. 3 as indicated.
Figure 5:
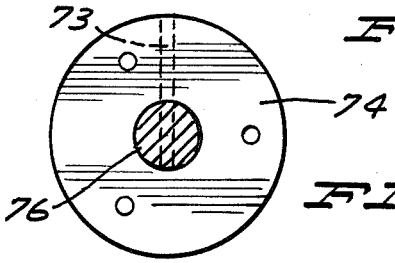
FIG. 5 is a view in horizontal section taken on line 5—5 of FIG. 4.
Figure 6:
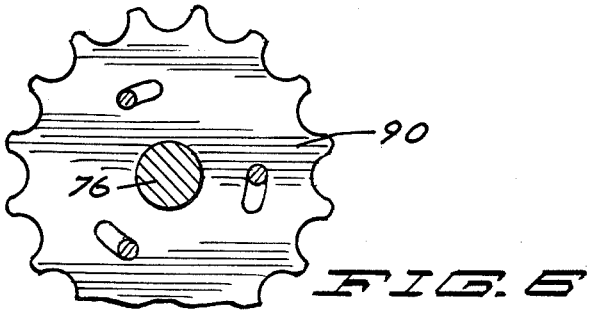
FIG. 6 is a view in horizontal section taken on line 6—6 of FIG. 4 as indicated.

As shown in FIG. 4, the gear members driving the mixing blades are located in the chamber 19.

Mounted upon a support 40 is a bearing plate member 41 secured by bolts 42 and mounted onto said top chamber wall 18 is an aligned bearing plate 43 secured by bolts 44 and journaled therebetween is a shaft 45. Journaled onto said shaft is a sprocket gear 47 having a pair of vertically spaced sprockets 49 and 50 and adjacent the bottom of said gear is an annular plate member 51. Mounted on top of said gear is a conventional slip clutch 52 pinned to the shaft 45 by a pin 53.

Though not here shown, the upper face of said plate 51 has a bearing race therein for non-frictional engagement therewith.

The member 55 is a stepped hold down bracket secured by bolt 56 to the support 40 and having an angled upper arm 56 extend over the rim of the plate member 51 to act as a hold down member, particularly when the clutch 52 is raised, as will be described.

Said shaft 45 extends upwardly of said bearing plate 43 having secured thereto a hub shaped supporting base 57 upon which is mounted for driving engagement therewith a circular plate member 59 having an upstanding rim 60 thereabout and removably disposed thereon is said mixing container 30 which is here shown for purpose of illustration as being a pail type cylindrical container. Said container has a non-slipping fit in being seated upon said plate member 59.

Though not here shown, said container may have some depending lugs which seat into accommodating recesses within said plate member 59.

It has been found that a better mixed product and a more efficient mixing operation is achieved by using medium sized containers such as 5 gallon containers.

Depending from said member 25 and extending into said container 30 is a rod member 63 having an angled upper end portion **63*a* held by a clip 66 secured to said member 25. The portion of said rod 63 extending into said container has a scraping blade 68** attached thereto bearing against the adjacent wall of said container.

Extending into said mixing container is a mixing blade or mixing paddle 70 mounted onto a shaft 72 and threaded into a hub 14 of a driving shaft 76. Said driving shaft extends upwardly through a bearing plate assembly 78 mounted onto said upper wall 25 and being substantially a duplicate of the aligned underlying bearing member 43.

Said bearing plate assembly 78 includes upwardly and downwardly extending hubs **78*a* and 78*b* to provide alignment for the shaft 76**.

Journaled into the upper portion of said shaft 76 is a sprocket gear 82 having a lower annular plate member 84 similar to the plate member 51 and the same is retained by the angled bracket 86 secured by a bolt 87 to the upper wall 25, the same being a duplicate of the bracket 55. Said sprocket gear 82 has pair of vertically spaced sprockets 89 and 90.

Secured to said shaft 76 by a pin 73 is a clutch 74 in releasable driving engagement with said sprocket gear 82 as illustrated and is representative of the engagement of the clutch member 47, 47′ and 74′ with their respective adjacent sprocket gears. Their disengagement is described elsewhere.

The table 11 extends to the right of the upstanding member 22 as illustrated in FIG. 3 and provides support for the drive assembly to be described.

Secured to the upright member 22 is an extended vertical plate member 103 carrying at the end thereof a monitor panel 112 to be further described.

Mounted beneath said member 103 and supported on a shelf 113 secured to the upright 22 is a gear reducer 11 driven by an attached motor 110 having a line 107 running to the control panel 112 from which lines 106 run to a power source.

Extending vertically through said gear reducer 111 is an upwardly extending drive shaft 105 and a downwardly extending drive shaft 115, said shafts respectively are driven at relative rates of speed. The control panel 112 will be set to have said respective shafts driven at desired rates of speed. In practice it has been found that a good working relative relation between said shafts is to drive the upper shaft at a speed of 300 RPM and the lower shaft at a speed of 10 RPM. The speed ratios are set by the control members or knobs carried by said panel 112 in connection with the line 107. This control of shaft speed is well known in the art.

A bearing plate 114 secured to the wall 22 holds the shaft 115 in alignment.

A bearing plate 121 mounted onto said wall 18 is shown having the shaft 115 journaled therethrough having a sprocket 122 secured thereon adjacent the lower end thereof. Passing over said sprocket and over said sprocket 47′ is a sprocket chain 124. Passing over the sprockets 50′ and 50 is a sprocket chain 126.

Secured to said upper cross member 25 and extending above said plate member 103 is a shelf bracket 126 having mounted thereon a bearing plate 128 through which is journaled the upward extending shaft 105.

A sprocket gear 131 is secured to adjacent the upper end portion of the shaft 105. Passing over said sprocket 131 and the sprocket 89′ is a sprocket chain 133. Passing over the sprockets 90′ and 90 is a sprocket chain 134.

The shafts 76 and 76′ have apertures 77 and 77′ therethrough so that when lifted as in the case of 76′, a pin P can be inserted in the hole 77′ to hold the shaft in raised position, said pin will rest upon the upper surface of the gear 84′. The shaft 76′ will thus be in an idle position.

A lever as will be described is provided to disengage the plate member 59 from driving engagement with the sprocket gear 47.

Upstanding from said top wall 18 adjacent said plate member 43 are a pair of studs or ear members 96 having pivoted therebetween by a pin 97 an eccentric lever 98 with a handle 99 and an upwardly angled end portion 99*a* underlying said plate member 59. Pivoted to said wall 26 is hook member 100 which when said lever handle 99 is lowered, said hook member engages the same and holds it down.

When said lever handle is lowered and engaged by the hook member 100, the plate member 59 and the hub 57 and shaft 45 are raised lifting the clutch 52 out of driving engagement with the sprocket gear 47 and thus the container 30 or 32, as the case may be, is out of driving connection with the sprocket gear 47.

To remove a mixing blade from a driving connection, with reference to shaft 76′, the shaft is raised to have the aperture 77′ above the sprocket gear 82′ and the pin P is inserted into the aperture to hold the shaft in raised condition. The clutch 74′ which is pinned to the shaft 76′ is raised therewith out of driving connection with said gear 82′ and thus the blade is in an inoperative position. To remove the blade 70 for replacement purposes it is unscrewed with its shaft 72 from the threaded connection 71. Shaft 72′ is not shown.

OPERATION

Mixing inks for printing purposes is an old practiced art which has not experienced a great deal of improvement in the apparatus used.

The structure herein represents substantial improvement in requiring but a simple power source to drive both the mixing containers and the mixing blades therein, moreover, although only two mixing containers are here shown, the frame supporting the mixing containers can be extended longitudinally to support additional mixing containers and be operated from the same single power source by the addition of sprocket chains.

To install a mixing container, referring to FIG. 3, the shaft 76′ is moved upwardly and held in raised position by the insertion of pin P through the aperture 77′ and resting upon the upper surface of the sprocket gear 82′.

The container 32 fits securely upon the table 59′, the material to be mixed having already been placed in the bucket and the mixing blade is lowered by removal of the pin P from the aperture 77′ in the shaft 76′.

The single power source through the use of the gear reduction member 111 drives the mixing container and the blades therein at different rates of speed. The blades desirably are rotated at ten times the speed of rotation of the containers such as on the order of 300 RPM for the blades and 30 RPM for the mixing containers.

As alluded to, additional mixing containers may be added by merely extending the table 12 and adding units of the sprocket driving elements.

The containers may be selectively disengaged from the driving mechanism as may the blades.

It appears that a more desirable mix is obtained by using a plurality of mixing containers and mixing smaller than otherwise quantities of the material to be mixed. With the use of a plurality of mixing containers, more than one color may be mixed at the same time.

It will of course be understood that various changes may be made in the form, details, arrangement and proportions of the product without departing from the scope of the invention which, generally stated, consists in a product capable of carrying out the objects above set forth, such as disclosed and defined in the appended claims.

What is claimed is:

1. An apparatus mixing liquid material, having in combination a supporting frame having a bottom wall and an upper cross member, a first bearing plate mounted onto said bottom wall, a support underlying said frame, a second bearing plate carried by said support underlying said first bearing plate, a first sprocket gear mounted onto said second bearing plate, a first shaft having said sprocket gear journaled thereon, extending therethrough and being journaled in said first and second bearing plates, a first clutch secured to said shaft in releasable driving engagement with said gear, a plate member, a mixing container carried by said plate member,
means secured to said shaft supporting said plate member,
a third bearing plate carried by said cross member vertically aligned with said first and second bearing plates,
a second shaft extending vertically journaled in said third bearing plate,
a second sprocket gear journaled onto said second shaft,
a second clutch secured to said second shaft in releasable engagement with said second sprocket gear,
a mixing blade releasably carried by said second shaft extending into said container,
driving means adjacent said frame, and
means in connection with said driving means driving said first and second sprocket gears at relative rates of speed.

2. An apparatus mixing liquid material, having in combination
a supporting frame having a bottom wall and an upper cross member,
a first bearing plate mounted onto said bottom wall,
supporting means underlying said frame,
a second bearing plate carried by said supporting means and spaced below said first mentioned bearing plate,
a first sprocket gear seated upon said second bearing plate,
a first shaft having said first sprocket gear journaled thereon extending therethrough and being journaled in said first and second bearing plates,
a first clutch secured to said first shaft in releasable driving engagement with said first sprocket gear,
a supporting member carried by said first shaft,
a mixing container carried by said supporting member,
a third bearing plate carried by said cross member aligned vertically with said first and second bearing plates,
a vertical extending second shaft journaled in said third plate bearing,
a second sprocket gear journaled onto said second shaft,
a second clutch secured to said second shaft in releasable engagement with said second sprocket gear,
a mixing blade releasably carried by said second shaft and extending into said container,
driving means adjacent said frame, and
means in connection with said driving means driving said first and second sprocket gears at relative rates of speed.

3. The structure of claim 2, wherein
said supporting means comprises an upstanding bracket.

4. The structure of claim 2, including
means carried by said bottom wall raising said supporting means and disengaging said first clutch from said first sprocket gear.

5. The structure of claim 2, including,
means holding said mixing blade and said second shaft in raised position.

6. The structure of claim 2, including
means carried by said supporting means holding down said first sprocket gear in operating position.

7. The structure of claim 2, wherein
said first sprocket gear includes an extended annular plate,
a bracket secured to said supporting means overlying an edge portion of said annular plate retaining the same down in operating position.

8. An apparatus mixing liquid material, having in combination
a supporting frame having a bottom wall and an upper cross member,
a plurality of mixing containers,
supporting members underlying said bottom wall respectively in vertical alignment with said containers,
first bearing plates mounted upon each of said supporting members,
second bearing plates mounted upon said bottom wall respectively underlying each of said containers and being respectively aligned with said first bearing plates,
first shafts respectively journaled between each of said aligned bearing plates,
first sprocket gears journaled upon each of said shafts,
a clutch secured to each of said shafts in releasable driving engagement with the sprocket gear thereon,
supporting members for each of said containers respectively secured to said shafts,
third bearing plates carried by said cross member in respective alignment with said first and second bearing plates,
vertically disposed second shafts respectively journaled in each of said third bearing plates,
second sprocket gears respectively journaled on said second shafts,
clutch members respectively mounted onto and secured to said second shafts in respective engagement with said sprocket gears thereon,
mixing blades carried by said second shafts respectively extending into said containers,
driving means adjacent said frame, and
means in connection with said driving means driving said first and second sprocket gears at relative rates of speed.

* * * * *